US006249939B1

(12) United States Patent
Kremer

(10) Patent No.: US 6,249,939 B1
(45) Date of Patent: Jun. 26, 2001

(54) METHOD AND DEVICE FOR WARPING USING A CONE SECTIONAL WARPING MACHINE

(76) Inventor: Hubert Kremer, Frevenstrasse 164, D-47929 Grefrath (DE)

( * ) Notice: Subject to any disclaimer, the term of this patent is extended or adjusted under 35 U.S.C. 154(b) by 0 days.

(21) Appl. No.: 09/462,317

(22) PCT Filed: Apr. 17, 1999

(86) PCT No.: PCT/DE99/01152

§ 371 Date: Mar. 22, 2000

§ 102(e) Date: Mar. 22, 2000

(87) PCT Pub. No.: WO99/58750

PCT Pub. Date: Nov. 18, 1999

(30) Foreign Application Priority Data

May 7, 1998 (DE) ..... 198 20 019

(51) Int. Cl.[7] ..... D02H 3/00; D02H 12/34
(52) U.S. Cl. ..... 28/191; 28/195
(58) Field of Search ..... 28/191, 195

(56) References Cited

U.S. PATENT DOCUMENTS

| | | | | |
|---|---|---|---|---|
| 4,974,301 | * | 12/1990 | Beerli et al. | 28/191 |
| 5,107,574 | * | 4/1992 | Beerli et al. | 28/191 |
| 5,410,786 | * | 5/1995 | Bogucki-land | 28/191 |
| 5,758,395 | * | 6/1998 | Lenzen et al. | 28/191 |
| 5,940,945 | * | 8/1999 | Bommer et al. | 28/198 |

FOREIGN PATENT DOCUMENTS

| | | |
|---|---|---|
| 3702293 | 9/1987 | (DE) . |
| 3812045 | 12/1988 | (DE) . |
| 0423067 | 4/1991 | (DE) . |
| 9112257 U | 1/1992 | (DE) . |
| 3432276 | 4/1995 | (DE) . |
| 19646087 | 5/1998 | (DE) . |

* cited by examiner

*Primary Examiner*—Andy Falik
(74) *Attorney, Agent, or Firm*—Pandiscio & Pandiscio

(57) ABSTRACT

Method for warping with a cone sectional warping machine, which winds threads in bands on a warping drum, wherein a support for a thread guide comb and the warping drum are displaced in relation to each other in correspondence with the increasing thickness of winding and predetermined warping data. The first band is monitored during a first measuring phase by a roll exerting contact pressure and the monitored displacement path is recorded as a function of the number of rotations of the warping drum. Roll pressure on the winding during the measuring phase is continuously monitored using measuring techniques. Displacement of the support is corrected if monitoring results differ from a predetermined setpoint. In order to even out the formation of the wind, the roll is arranged at a given distance from the warping drum when warping of the first band is started. The monitoring of the roll is automatically started with increasing thickness of the winding as soon as the winding causes the roll to rotate.

9 Claims, 1 Drawing Sheet

METHOD AND DEVICE FOR WARPING USING A CONE SECTIONAL WARPING MACHINE

BACKGROUND OF THE INVENTION

Field of the Invention

Figure 1:
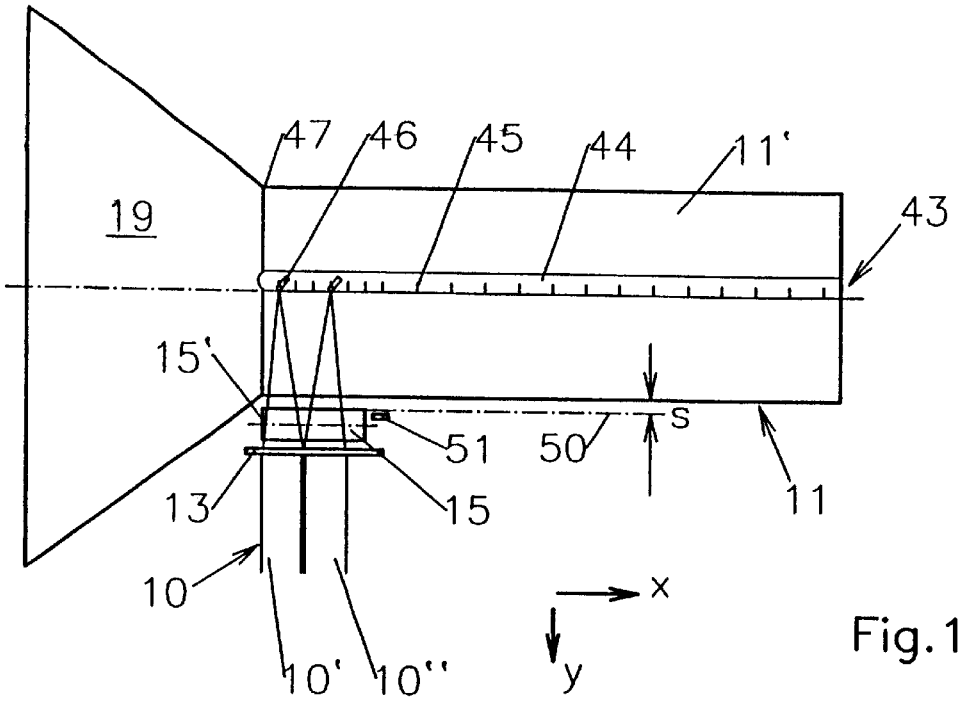

This invention relates to a method for warping with a cone sectional warper that winds up threads in bands on a warping drum, in which a support for a thread guide comb and the warping drum are shifted in parallel relative to one another corresponding to the growing wind thickness and predetermined warping data, with the first band being scanned during a measurement phase by a roll pressed against it, and the scanned displacement path is recorded as a function of the number of rotations of the warping drum and with the pressure of the roll on the wind being monitored by continuous measurement during the measurement phase, and particularly in case of a deviation of the monitored result from a predetermined setpoint, with a correction being made in the advance of the support according to Patent . . . (Patent Application 196 46 087.5–26).

Warping consists of winding up warp threads in bands. The winding is accomplished by rotation of the warping drum. The first band and with it all of the following bands supported on it are given a parallelogram cross section by the special shape of the warping drum, namely its conicity. The speed of rotation and the forward advance of the warping drum are determined by item-specific data for the threads, such as their diameter or the number and type of capillaries. Different winding speeds and thread tension forces and/or roll pressure applied cause different buildups of the wind. This is manifested, for example, in support differing in strength for soft or hard winding for the next band.

The underlying purpose of the principal Application is to be able to exert an effect on the wind buildup to provide for immediate detection and elimination of irregularities.

This problem of the principal Application is solved by continuously monitoring by measurement the pressure of the roll on the wind during the measurement phase and/or during the further winding and/or copying, and if there is a deviation of the monitored result from a predetermined setpoint, by making a correction of the support advance feed.

The method is essentially carried out by placing a roll on the wound-up band and supporting it on two pressure sensors, whose measurements can be utilized by the control device. The pressure sensors can detect both excessive and inadequate pressures. If the measured pressure differs too greatly from the mean value or setpoint, the warping data can be corrected. Great unevenness or pressure variations that are difficult to correct arise from thickening of the band because the thread array is knotted in the tying strip of the warping drum at the beginning. Winding over the knots also leads to severe unevenness when the tie points are recessed in the conical drum. This can lead to measurement errors or damage to the threads of the band during scanning by the roll. The measured pressure changes may also be very large, so that they are outside a measurement range by a given average and can thus lead to control problems. For example, it is then necessary to smooth out pressure peaks. The problem of the present invention therefore consists of improving the method described initially so that no irregularities in the pressure contact of the roll occur during the initial rotations after hanging the band, and thus any damage to the roll or to the threads is prevented.

The aforementioned problem is solved by positioning the roll at a predetermined distance from the warping drum at the beginning of the warping of the first band, and by starting the measurement phase automatically with growing wind thickness as soon as the wind sets the roll in rotation.

Such a method causes the warped band to contact the measurement roll only in a later stage of the warping process. Only when the band reaches a thickness that conforms to the predetermined distance is the band scanned by the roll. The distance is preset so that the substantial unevenness from the hanging knots and other factors involving the beginning of warping no longer have any effect on the result of measurement. The initial unevenness and any pressure variations have no effect in the method described. The measurement device provided can be used from then on without adjusting for pressure peaks and does not have to be reprogrammed.

DE-OS 37 02 293 discloses a method for warping with a warping drum, in which winding is done with a preset warping carriage advance feed and the base winding produced is scanned with a scanning element. A corrected warp carriage advance is used corresponding to the scanning result. This method is to be used to exclude the influence of the hard warping drum backing and other factors associated with the beginning of warping from the measurement process. To scan the wind circumference with the scanning element, the warping drum has to be stopped. This stopping, scanning, and correction of the advance makes the measuring and warping process substantially more difficult. Furthermore, there is the danger that a stepped wind will be formed by stopping the warping drum and subsequently restarting it.

The warping method pursuant to the invention can be carried out by shifting the support only parallel to the warping drum and with a support advance feed adjusted for the thread data before starting the measurement phase. The thread data, for example, are the thickness and density of the thread. The support feed adjusted for this, combined with the motion of the support made parallel to the warping drum, brings about the winding of a partial band with parallelogram cross section tuned to the conicity of the warping drum even before starting the phase of measurement by the roll.

The warping method can be carried out so that the measurement phase starts automatically with a measured pulse emitted by the rotating roll. This provides for the measurement phase to be started only when the roll is rotating. It is guaranteed that a wind with spacing conforming to the predetermined distance is built up. The control mechanism is addressed by tapping the measurement pulse and the measurement phase is automatically started. It is not necessary to interrupt the warping process. No time is lost by interrupting, and the danger of stepwise winding is avoided.

It is advantageous to carry out the warping method by tapping the measurement pulse as soon as the measurement roll is set in motion. A very early phase of the motion is utilized as the starting point of measurements. It is not necessary for the roll to execute a full rotation, but for example half a rotation or even less is sufficient. This makes possible the use of a simple detector, i.e. a speed-independent detector, to record the motion, for example a proximity sensor with a simple aperture.

It may also be advantageous to carry out the method with the measurement pulse being tapped as soon as the speed of rotation of the roll has reached a given value. This avoids unforeseen random rotations of the roll from any contact or vibrations being interpreted as the start for the measurement process. The setting and measurement of the speed of rotation make possible a more reliable determination of actual contact of the roll with the wind. For example, the measurement pulse can be tapped when the speed of rotation of the roll at its outer circumference has reached half of the winding speed of the wind, or half the circumferential speed of the wind.

It may be advantageous in the method for warping with a cone sectional warper in which threads are wound in bands on a warping drum, to retract the roll after the measurement phase during the further winding corresponding to an average value obtained in the measurement phase, and to press it against the wind and continuously to monitor the pressure of the roll during the further winding and/or copying by measurement, and in case of a deviation of the result of monitoring from a predetermined setpoint, to make a correction to the support advance feed. This provides the ability to have a corresponding influence on the wind buildup. A check is made during the copying of the first band as to whether the wind buildup is correct, for example in case of problems from the increase of thread tension resulting from decreasing thread supply of the bobbins, or from a multiplication effect from inexact input parameters. Complete regulation of the pressure of the roll is thus possible during the entire wind buildup.

It is advantageous to carry out the method by positioning the roll with the same predetermined distance from the warping drum also at the beginning of the warping of the other bands, and to warp with the same warping data as for the first band until the measurement phase is reached. The predetermined distance of the roll in turn makes it possible easily and reliably to avoid irregularities when applying pressure to the roll during the first rotations after hanging the band. The choice of the same warping data until the measurement phase is reached guarantees the same type of winding and a corresponding length of the next band and the following bands. It is not necessary to scan the wind with the roll.

It is also advantageous to design the method so that the wind buildup of the first band starting with the measurement phase is copied when warping the other bands. This guarantees exactly the same buildup of the first band and the following bands. The supporting action of the bands is always the same because of this, and no irregularities of bands or different warp lengths are obtained.

The invention relates to a cone sectional warping machine with a support carrying a thread guide comb, which is adjustable on a machine frame parallel to a warping drum, with a motorized advance drive controllable by a control device to produce relative motions corresponding to the increase of the wind thickness between the warping drum and the support, with a roll scanning the circumference of the wind with pressure, whose displacement can be stored by the control device as a function of the number of rotations of the warping drum and that is supported on at least one pressure sensor that activates the control device during the measurement phase, with the control device controlling the roll in the corrective direction in case the measured pressure differs from a predetermined setpoint.

The cone sectional warping machine described above can be improved in the sense of avoiding irregularities in the pressure contact of the roll during the first rotations after hanging the band by providing a stop with which the roll is positioned at a distance from the warping drum during warping until a predetermined wind thickness of the band is reached. This provides for simple adjustment of the roll before warping and reliable positioning during the beginning of the warping process. No pressure variations are passed along to the control device. Any vibrations from startup and from the first rotations of the warping drum have no effect, because the measurement phase has not yet started.

The cone sectional warping machine can be designed by providing a pulse generator that emits a pulse to start the measurement phase with a predetermined speed of rotation of the roll. The pulse generator, preferably located near the roll, causes the rotation of the roll to be recorded and brings about simple starting of the measurement phase. It is adjustable independently of the control device, which contributes to a more exact measurement.

The stop is present on the support, so that it can always be used in the same way when shifting the support to warp the following bands, and a constant distance of the roll is always guaranteed. The roll can be held against the stop without pressure.

Figure 2:
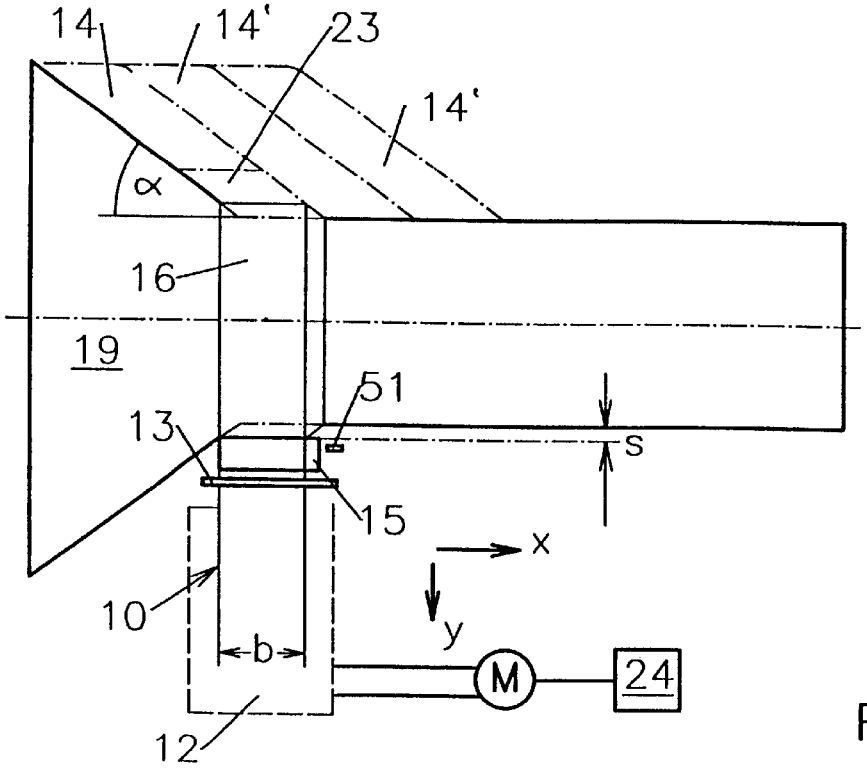

The invention will be described with reference to an example of embodiment shown in the drawing. The drawing shows:

FIG. 1 a side view of a cone sectional warping drum illustrated schematically that is unwound, and FIG. 2 an elevation view corresponding to FIG. 1 with wound bands in schematic illustration.

A cone sectional warping machine has a warping drum 11 as an essential component, that can rotated from a warping drum drive, not shown. At one end the warping drum 11 has a cone 19 that serves as lateral support for the threads 10 wound up in bands, that run in to the cone sectional warping machine from the bobbins of a creel, not shown. The threads 10 form a thread array that is arranged by the thread guide comb 13 over a band width b. The thread array is guided over a measuring roll, not shown, to drive it and thus to measure the thread length. FIG. 1 shows that the threads 10 of the thread array are tied in bundles and the bundles 10', 10" are fastened to the warping drum 11. The warping drum has a hanger device 43, namely a hanger grid 44, in which there are hanger pins 45. Each knot 46 of a bundle 10' or 10" is fastened by hanging on a hanger pin 45. As soon as the warping drum 11 is driven to rotate, the threads 10 are drawn off from the bobbins of the creel and wound up on the warping drum 11. It is to be understood that the warping drum 11 is moved in the rotational sense in which the threads 10 are drawn through the thread guide comb 13 without hindrance, i.e. upward at the beginning of rotation.

The threads 10 are wound up in bands. FIG. 2 shows that a parallelogram cross section of a band is obtained to support it axially. The cross section of a first band 14 and of other bands 14" is shown by way of example in the top half of FIG. 2. The parallelogram shape is achieved by appropriate relative motions between the warping drum 11 and the thread guide comb 13, which is carried on a support 12. Its relative motion parallel to the axis of the warping drum in an x-direction indicated in the Figures is produced by an advance feed drive M. This is shown schematically in FIG. 2 together with the support 12 and a control device 24. The support advances through a servomotor representing the drive M, that is fixed to the support and engages in a frame rail or in a toothed rail of a machine frame, not shown. When driven by the servomotor, the support 12 and with it the thread guide comb 13 is displaced.

The support advances with consideration of the cone angle $\alpha$ and in proportion to the wind thickness that is growing during the winding. While the cone angle $\alpha$ is a fixed parameter and is taken into consideration appropriately when determining the support advance, the growing wind thickness has to be detected by measurement. This is done with a roll 15 that is practically the width of a band, and is mounted to rotate on the support 12. A wind 16 builds up more quickly or more slowly depending on the thread specifics, and the support advance has to be correspondingly larger or smaller. For example if the yarn is thick and dense, the axial displacement of the roll 15 in the x-direction has to be greater in millimeters per angular degree and per rotation of the drum.

The wind thickness can be measured with the roll 15. To do this, the roll 15 is adjustable perpendicular to the axis of the warping drum 11 in the y-direction, in a way not illustrated. When the warping drum 11 is rotated, the wind 16 builds up layer by layer. It presses against the roll 15 and displaces it according to the increase of winding thickness. The scanned displacement is recorded as a function of the number of rotations of the warping drum 11.

The winding is executed under pressure, by the roll 15 being pressed against the wind 16. The scanning of the wind 16 with the roll 15 is therefore done under contact pressure. If a desired pressure is exceeded, a motion parallel to the axis in the x-direction and a radial motion in the y-direction are performed by means of the servomotor in small steps until the desired pressure again prevails. To this end, the control device 24 shown in FIG. 2 is provided, that is activated by the roll 15 through at least one pressure sensor, not shown. The activation occurs during a measurement phase 23 of the winding. Storage of the displacement path as a function of the number of rotations of the warping drum 11, and measurement of the pressure of the roll 15 on the wind 16, can be utilized after completion of the measurement phase 23 to determine an average value of the advance feed. Therefore, an average displacement path per rotation of the warping drum, and with it an average advance feed is calculated. This corresponds to the advance feed that is used during copying following the measurement phase 23.

The measurement phase 23 usually extends over a relatively small wind thickness. It is therefore possible that the measurement is not exact enough, and that changes of the pressure of the roll 15 on the wind 16 occur during the further winding of the first band 14. The result would be an incorrect wind buildup. The method can therefore be carried out by continuously monitoring by measurement the pressure of the roll 15 on the wind 16 during the further winding or copying subsequent to the measurement phase 23, and in case the result of monitoring is different from a predetermined setpoint, by making a correction to the support advance feed.

However, the method could also be carried by no further winding or copying following the measurement phase 23, but with the measurement phase 23 being carried out to the end of the winding of the first band 14, with measured monitoring occurring in the prescribed range by wind section or continuously, as well as a correction of the support advance feed, if the monitoring result shows a deviation from the predetermined setpoint. Finally, the method could also be carried out by actually monitoring by measurement continuously or by wind section during the measurement phase 23, but with no correction of the support advance feed being made if there is a deviation of the result of monitoring from a predetermined setpoint. In that case, the entire first band 14 is completed in such a measurement phase 23 based on the item-specific pressure. This is determined by the item-specific data for the threads 10, for example corresponding to their diameter etc. A deviation of pressure on the roll 15 can then be compensated by thread tension correction, but this can be considerably smaller than with known methods.

It is common to all of the aforementioned methods that the measurement phase 23 is initiated in a special way. For this purpose, the roll 15 is positioned according to FIG. 1, namely at a predetermined distance s in its zero position. In this zero position, the left face 15' of the roll is flush with the transition line 47 of the cone 19 to the warping drum body 11'. The distance s is a few millimeters. This adjustment is made by the roll 15 pushing against a stop 50, shown schematically, that is located on the support 12. There is a pulse generator 51 in the vicinity of the roll 15 that is connected, for example, to the control device 24. The pulse generator 51 can be activated only when the roll 15 rotates. In this case, a proximity transmitter, not shown, approaches the pulse generator 51 and triggers a pulse, which is utilized.

Because of the separation s, the beginning of rotation of the warping drum 11 is not identical with the beginning of rotation of the roll 15. Therefore, rotation of the warping drum 11 is first generated. which leads to the winding of threads 10 without the roll 15 being in contact with the wind 16 then building up. Because of this it remains stationary. Only when the growing wind 16 has become so thick in accordance with FIG. 2 that it contacts the roll 15 does the roll begin to rotate. Before this, the wind 16 has no effect on the roll 15, or the converse. Consequently no irregularities of the wind 16 can be transmitted to the roll 15. Such irregularities, for example, are caused by knots 46 of the strands 10', 10", and by the tying strip 43. It has been found that irregularities of the wind 16 caused by this no longer have any active effect on the scanning by the roll 15 when the distance s has been set appropriately.

Until the wind 16 contacts the roll 15, the support 12 is moved only parallel to the warping drum 11. Motion of the support transverse to the warping drum 11 is precluded, since the wind 16 before starting the measurement phase does not press against the roll 15. The thread data are used to determine an item-specific advance feed parameter until the measurement phase starts. For example the support 12 is shifted with a larger support advance feed with thicker threads than with thinner threads. The support advance feed is also determined otherwise, namely with a control device 24 into which the thread-specific data are input, and which calculates the support advance feed with consideration of the cone angle $\alpha$.

As soon as the measurement roll 15 contacts the outer circumference of the wind 16, it is set into rotation by it. A measurement pulse is tapped from the rotating roll 15 by means of the pulse generator 51, that can be used to start the measurement phase 23 automatically. The measurement pulse can be tapped from the rotating roll 15 as soon as the roll 15 is set into motion, or at the latest after almost one complete rotation of the roll 15. The measurement phase 23 should be initiated at the latest when its circumferential velocity is as great as the circumferential velocity of the wind 16 rotating with the warping drum 11. More practically, the measurement phase 23 will be started as soon as the roll 15 has reached a predetermined value of circumferential velocity, e.g. half of its final speed of rotation when unwinding the thickness s on a wind, as long as it is still in the immediate area of the stop 50.

When winding the first band 14 to the end, the method follows one of the several possibilities described above. The completely wound band 14 is shown schematically by way of example in FIG. 2 on one end of the warping drum resting against the cone 19. When warping the later bands 14', of which two bands with width b as for the first band 14 are shown in FIG. 2, the predetermined separation s from the warping drum body 11' is first fully wound. This occurs by using an advance as in full winding corresponding to the spacing s of the first band 14, namely an advance corresponding to the predetermined warping data described above. The wind buildup of the first band 14 is then copied, so that the later bands 14' have a structure totally identical with the first band 14. Accordingly the warp is built up uniformly overall to a sufficient degree. The winding of the bands 14' up to a wind thickness corresponding to the spacing s with predetermined warping data in this case plays no critical role for the subsequent wind buildup, because the spacing s is relatively small. The various bands affect one another only slightly in this range. In any case, it is important for the measurement phase 23 of the first band 14 and also the winding and copying of the later bands 14' to be started automatically. Any necessary corrections of the support advance feed, including those resulting from a change of a predetermined setpoint, require no shutdown of the winding.

What is claimed is:

1. A method for warping with a cone sectional warper that winds thread on a warping drum portion of the warper, the method comprising the steps of:

providing a support for a thread guide comb adjacent the drum, the support being movable in a direction parallel to an axis of the drum;

moving the support and drum relative to one another parallel to the drum axis to move the comb in response to a growing wind thickness and predetermined warping data;

providing a roll on the support and positioning the roll spaced from the drum, the roll remaining spaced from the drum and wind thereon until the growing wind thickness of a first band of threads contacts the roll to start rotation of the roll;

monitoring pressure of the roll in contact with the wind thickness on the wind and the rotational speed of the roll; and providing a control device which records parameters including the rotative speed of the drum, and pressure of the roll on the wind, and detects deviation of the parameters from a predetermined setpoint, and initiates corrective movement of the support, and thereby the thread guide comb, to correct the pressure of the roll on the wind and to even out formation of the wind on the drum;

wherein the monitoring of the roll is automatically started with a pulse tapped from the rotating roll.

2. The method in accordance with claim 1, characterized by the fact that until the monitoring of the roll starts, the support (12) is moved only parallel to the warping drum (11) and with a support advance conforming to the predetermined warping data.

3. The method in accordance with claim 1, characterized by the fact that the monitoring pulse is tapped as soon as the roll (15) is set in rotative motion.

4. The method in accordance with claim 1, characterized by the fact that the monitoring pulse is tapped as soon as the speed of rotation of the roll (15) has reached a predetermined value.

5. The method in accordance with claim 1, characterized by the further steps of retracting the roll after the corrective movement of the support and during further winding corresponding to an average value determined in the monitoring of the roll, and pressing the roll against the wind (16), and monitoring the pressure of the roll (15) during the further winding, and in case of a deviation of the result of monitoring from the predetermined set point, making a correction to the support advance.

6. The method in accordance with claim 1, characterized by the further steps of positioning the roll (15) at predetermined distances from the warping drum (11) at the beginning of the warping of further bands (14') of threads, and performing warping according to the predetermined warping data until the monitoring is started.

7. The method in accordance with claim 1, characterized by the fact that wind buildup of a first band (14) of threads after the monitoring of the roll is copied in the warping of further bands (14') of threads.

8. A cone sectional warping machine comprising:

a support (12);

a thread guide comb (13) mounted on said support, (which is adjustable) said support being movable on a machine frame parallel to a warping drum (11);

a motorized advance drive (M) controllable by a control device (24) to produce relative motions between the warping drum (11) and the support (12) corresponding to an increase of a wind thickness;

a roll (15) mounted on the support for monitoring the circumference of the wind with pressure, displacement of the roll relative to the drum being monitored and stored by the control device (24) as a function of a number of rotations of the warping drum (11); and at least one pressure sensor that activates the control device;

the control device controlling the roll (15) in a corrective direction in case a measured pressure differs from a predetermined setpoint;

a stop (50) with which the roll (15) is positioned at a distance from the warping drum (11) during warping until a predetermined wind thickness of a band (14) of thread is reached; and a pulse generator (51) that emits a pulse to start the monitoring of the roll at a predetermined speed of rotation of the roll (15).

9. The cone sectional warping machine in accordance with claim 8, characterized by the fact that the stop (50) is mounted on the support (12).

* * * * *